US008585509B2

(12) United States Patent
Yeh

(10) Patent No.: US 8,585,509 B2
(45) Date of Patent: Nov. 19, 2013

(54) PUTTING GREEN SIMULATOR

(76) Inventor: Mei-Chu Yeh, Tainan (TW)

( * ) Notice: Subject to any disclaimer, the term of this patent is extended or adjusted under 35 U.S.C. 154(b) by 133 days.

(21) Appl. No.: 13/289,004

(22) Filed: Nov. 4, 2011

(65) Prior Publication Data

US 2013/0116059 A1 May 9, 2013

(51) Int. Cl.
*A63B 69/36* (2006.01)

(52) U.S. Cl.
USPC ..... 473/160

(58) Field of Classification Search
USPC ..... 473/157–163, 181
See application file for complete search history.

(56) References Cited

U.S. PATENT DOCUMENTS

| | | | | | |
|---|---|---|---|---|---|
| 1,612,291 | A * | 12/1926 | Jackson George P | ..... | 473/160 |
| 2,678,823 | A * | 5/1954 | Hugman Robert H H | ... | 52/126.6 |
| 3,858,887 | A * | 1/1975 | Wallin | ..... | 473/157 |
| 4,018,436 | A * | 4/1977 | Leigh | ..... | 473/163 |
| 4,114,887 | A * | 9/1978 | DelRaso | ..... | 473/153 |
| 4,211,417 | A * | 7/1980 | Brown | ..... | 473/160 |
| 4,240,637 | A * | 12/1980 | Cross et al. | ..... | 473/160 |
| 4,611,809 | A * | 9/1986 | Gettelfinger | ..... | 473/161 |
| 4,790,538 | A * | 12/1988 | Gettelfinger | ..... | 473/161 |
| 4,978,127 | A * | 12/1990 | Juel, Jr. | ..... | 473/160 |
| 5,172,914 | A * | 12/1992 | Primerano | ..... | 473/171 |
| 5,863,256 | A * | 1/1999 | MacLean et al. | ..... | 473/160 |
| 6,050,901 | A * | 4/2000 | Davis | ..... | 473/160 |
| 6,746,338 | B1 * | 6/2004 | Keaton | ..... | 473/160 |
| 7,563,171 | B2 * | 7/2009 | Barz | ..... | 473/185 |
| 2003/0190969 | A1 * | 10/2003 | Barlow et al. | ..... | 473/157 |
| 2004/0137995 | A1 * | 7/2004 | Chang | ..... | 473/163 |
| 2005/0197196 | A1 * | 9/2005 | Ostiguy | ..... | 473/160 |
| 2007/0042829 | A1 * | 2/2007 | Dennesen | ..... | 473/162 |
| 2008/0274817 | A1 * | 11/2008 | Gibbons | ..... | 473/160 |
| 2010/0075771 | A1 * | 3/2010 | Martens | ..... | 473/160 |

* cited by examiner

*Primary Examiner* — Mark Graham
(74) *Attorney, Agent, or Firm* — Rosenberg, Klein & Lee

(57) ABSTRACT

A putting green simulator comprises a base assembly, a plurality of base boards which are connected to each other and connected to the base assembly, and a plurality of adjusting members mounted on the base boards. Each of the base boards includes a body and two first screw seats of arbitrary length. The first screw seats are able to control the height of the bodies with respect to the ground, adjusting the adjusting members can control the curvature of the bodies, so that the putting green simulator can simulate different curvature of the putting green.

7 Claims, 12 Drawing Sheets

PUTTING GREEN SIMULATOR

BACKGROUND OF THE INVENTION

1. Field of the Invention

The present invention relates to a putting green simulator, and more particularly to a putting green simulator capable of simulating the lay of the real green, and the base boards of the same.

2. Description of the Prior Art

With the improvement of living standard, health has become a priority and people would like to take part in recreational activities to stay healthy. Golf is a slow sport, people can enjoy the view of the wild green grass while relaxing themselves by playing golf, therefore, many people like playing golf. Golf is also an expensive game since it demands large area of land, which is not good for the popularization of golf.

Therefore, various artificial putting aids or devices were invented to make practicing golf more readily accessible. However, assembling the conventional artificial putting green device requires professional skills, and once assembled, the artificial putting green device cannot be adjusted in inclination of the putting slope or the curve of the putting track. Conventional artificial putting aids are unable to simulate the lay of the real green, lack adjustability, which makes golf practice less pleasurable.

The present invention has arisen to mitigate and/or obviate the afore-described disadvantages.

SUMMARY OF THE INVENTION

The primary object of the present invention is to provide a putting green simulator which comprises: a base assembly, a plurality of base boards, a plurality of stop members detachably mounted on the base boards, a plurality of adjusting members mounted on the base boards, a ball return member connected to the base assembly, and a plurality of second screw seats mounted to the base boards.

The base assembly includes a base, and a supporting member on the base, the supporting member is formed with at least one aperture, and a plurality of spaced grooves is formed at a right end of the supporting member.

The plurality of base boards are flexible and each include a body, a plurality of spaced grooves formed in the body, a first chamber and an opposite second chamber protruding downward from the body, two opposite first screw seats protruding downward from the body, a plurality of spaced engaging blocks formed at a left end of the body, a plurality of engaging concaves formed at a right end of the body.

The plurality of adjusting members each include a bolt, a threaded sleeve and a connecting rod. The bolt has a first end fixed in the first chamber and a second, the threaded sleeve has a first end and a second end screwed with the second end of the bolt, the connecting rod has a first end pivoted to the first end of the threaded sleeve and a second end fixed to the second chamber.

The base boards are connected to one another by engaging the engaging blocks in the engaging concaves, a leftmost base board of the base boards is fixed to the right end of the supporting member in such a manner that the engaging blocks of the leftmost base board are engaged in the grooves of the supporting member. The rightmost base board is placed against the ground and connected to a hitting area.

Yet another object of the present invention is to provide a base board which is flexible and comprises a body, a plurality of spaced grooves formed in the body, a first chamber and an opposite second chamber protruding downward from the body, two opposite first screw seats protruding downward from the body, a plurality of spaced engaging blocks formed at a left end of the body, a plurality of engaging concaves formed at a right end of the body.

By the above arrangements, the present invention has the following advantages: the first screw seats of arbitrary length can be used to control the height of the bodies with respect to the ground. Further, rotating the threaded sleeve of the adjusting member can extend or retract the bolt, so that the curvature of the bodies can be adjusted, so as to simulate different curvatures of the putting green, making the putting more difficult and more fun.

DETAILED DESCRIPTION OF THE PREFERRED EMBODIMENTS

Figure 1:
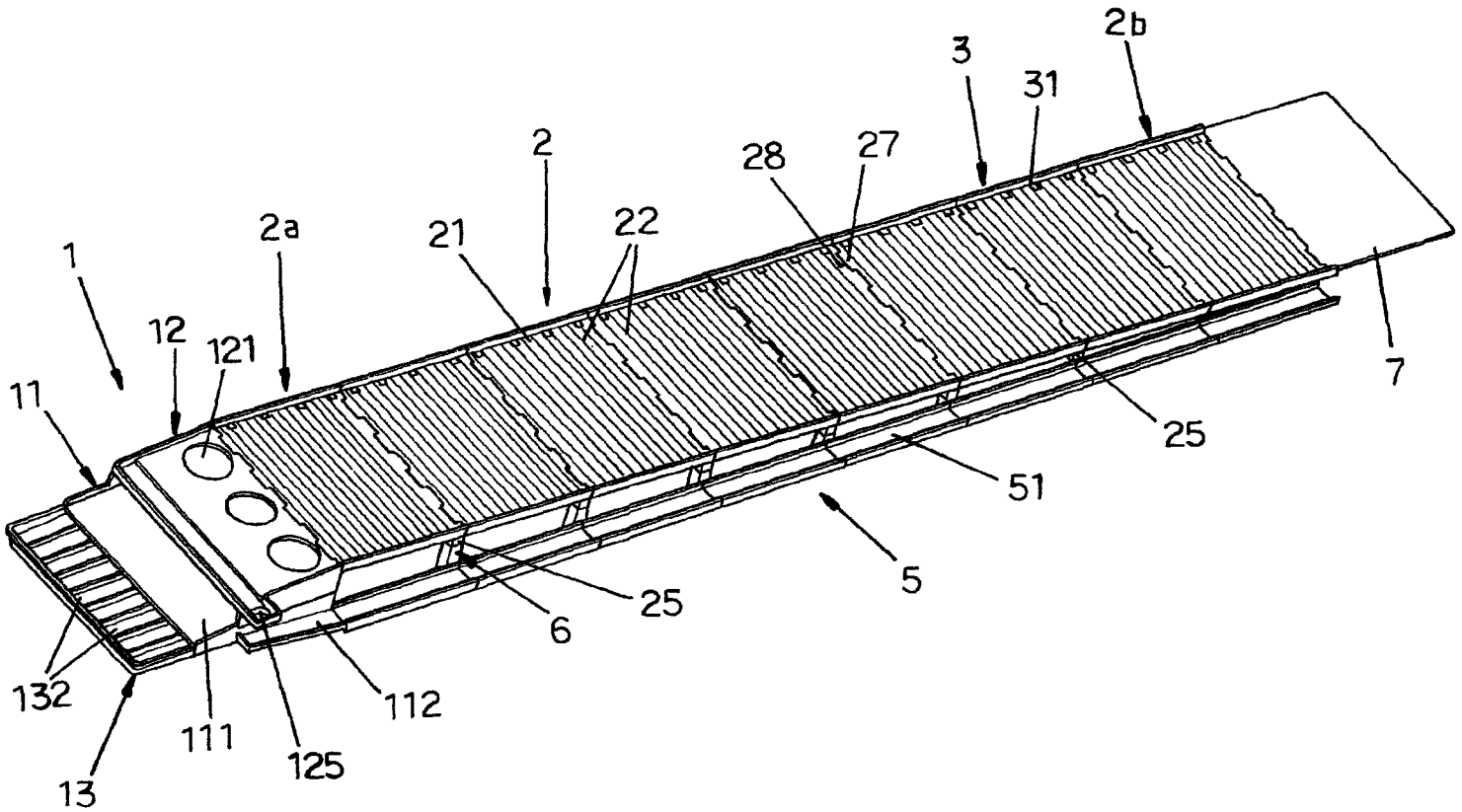
FIG. 1 is a perspective view of a putting green simulator in accordance with the present invention.

The present invention will be clearer from the following description when viewed together with the accompanying drawings, which show, for purpose of illustrations only, the preferred embodiment in accordance with the present invention.

Referring to FIGS. 1-5, a putting green simulator in accordance with the present invention comprises: a base assembly 1, a plurality of base boards 2, a plurality of stop members 3 detachably mounted on the base boards 2, a plurality of adjusting members 4 mounted on the base boards 2, a ball return member 5 connected to the base assembly 1, and a plurality of second screw seats 6 mounted to the base boards 2.

The base assembly 1 includes a base 11, a supporting member 12 on the base 11, and a ball receiving member 13 at the left end of the base 11. The base 11 is provided on its top surface with a slope 111 and an inclined guiding section 112. The supporting member 12 is formed with at least one aperture 121, a concave portion 122 formed at the lower end of the supporting member 12 and in communication with the at least one aperture 121, a plurality of spaced grooves 123 at the right end of the supporting member 12, and a ball falling hole 125 connected to the inclined guiding section 112. The ball receiving member 13 is formed with a receiving concave 131 connected to the slope 111 and a plurality of receiving grooves 132 formed in the receiving concave 131. The slope 111 of the base 11 is in communication with the concave portion 122 of the supporting member 12.

Figure 5:
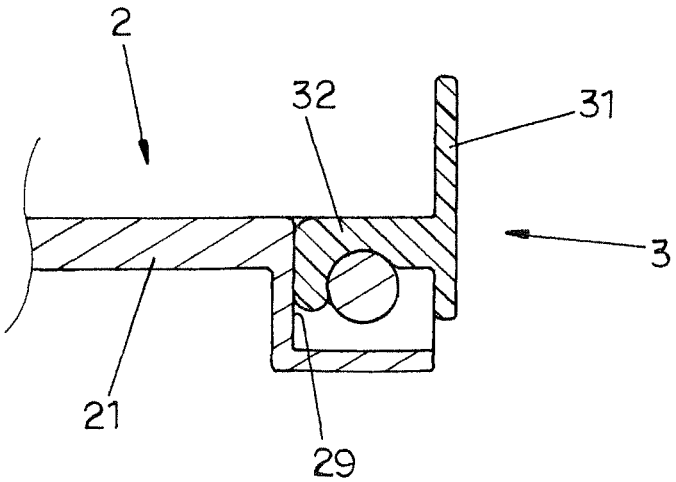
FIG. 5 is a cross sectional view of a part of the putting green simulator in accordance with the present invention, showing that an engaging protrusion is engaged in an engaging groove.
Figure 6:
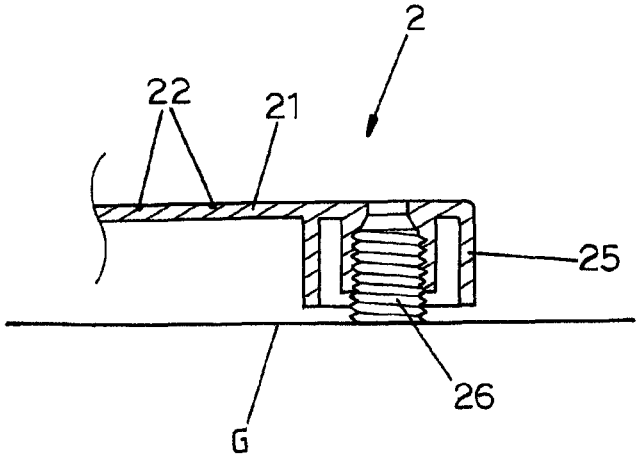
FIG. 6 is a cross sectional view of a part of the putting green simulator in accordance with the present invention, showing that a first screw is screwed in a first screw seat.
Figure 7:
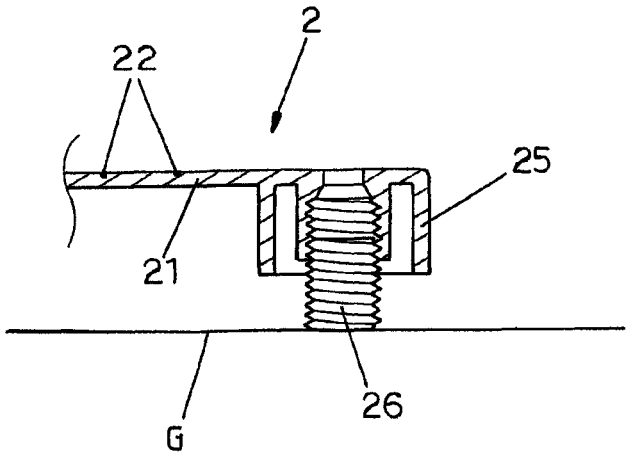
FIG. 7 is a cross sectional view of a part of the putting green simulator in accordance with the present invention, showing that a length of the first screw exposed out of the first screw seat.

Each of the base boards 2 is flexible and includes a body 21, a plurality of spaced grooves 22 formed in the body 21, a first chamber 23 and an opposite second chamber 24 protruding downward from the body 21, two opposite first screw seats 25 protruding downward from the body 21, two first screws 26 screwed to the first screw seats 25 (as shown in FIGS. 6 and 7), a plurality of spaced engaging blocks 27 formed at the left end of the body 21, a plurality of engaging concaves 28 formed at the right end of the body 21, and a plurality of spaced engaging grooves 29 (as shown in FIG. 5) formed at the front and rear ends of the body 21.

The stop members 3 are mounted to the front and rear ends of the respective body 21 and each include a stop board 31 and a plurality of engaging protrusions 32 formed on the stop board 31 for engaging with the engaging grooves 29.

Figure 8:
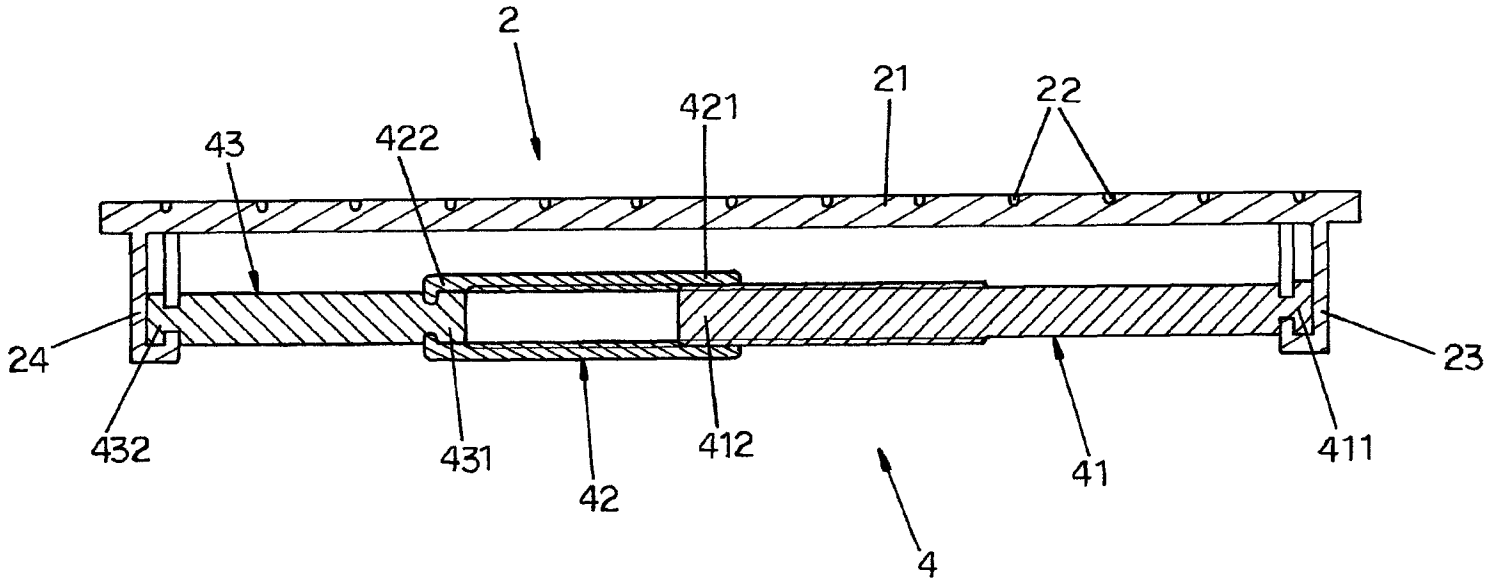
FIG. 8 is a cross sectional view of a part of the putting green simulator in accordance with the present invention, showing that the relative positions of a bolt, a threaded sleeve and a connecting rod of an adjusting member.

Referring to FIG. 8, each of the adjusting members 4 includes a bolt 41, a threaded sleeve 42 and a connecting rod 43. The bolt 41 has a first end 411 fixed in the first chamber 23 and a second end 412. The threaded sleeve 42 has a first end 422 and a second end 421 screwed with the second end 412 of the bolt 41. The connecting rod 43 has a first end 431 pivoted to the first end 422 of the threaded sleeve 42 and a second end 432 fixed to the second chamber 24.

The ball return member 5 includes a guiding track 51 connected to the inclined guiding section 112 of the base 11.

Figure 9:
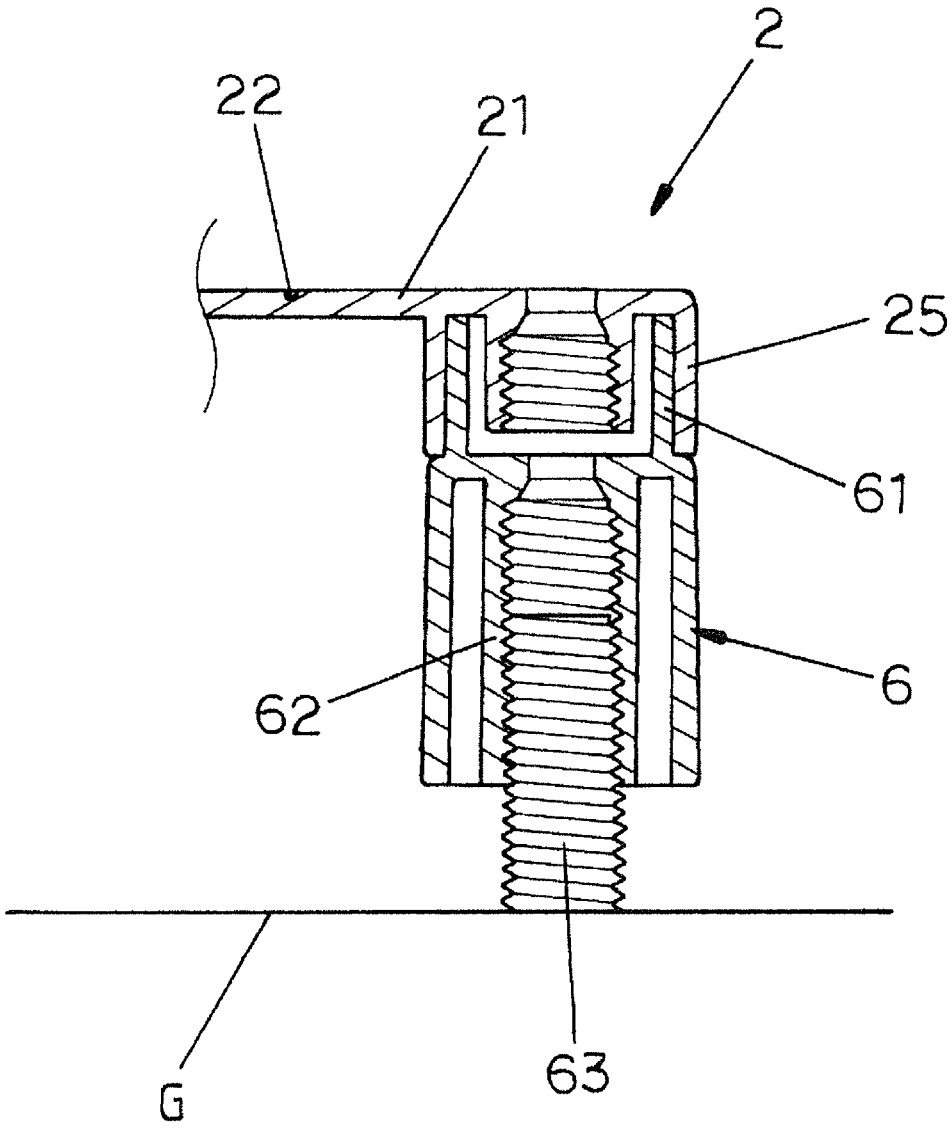
FIG. 9 is a cross sectional view of a part of the putting green simulator in accordance with the present invention, showing that a second screw seat is engaged with the first screw seat.

Referring then to FIG. 9, each of the second screw seats 6 includes an engaging portion 61 for engaging with the first screw seat 25, a threaded pipe 62 extending downward from the engaging portion 61, and a second screw 63 screwed to the threaded pipe 62.

Figure 10:
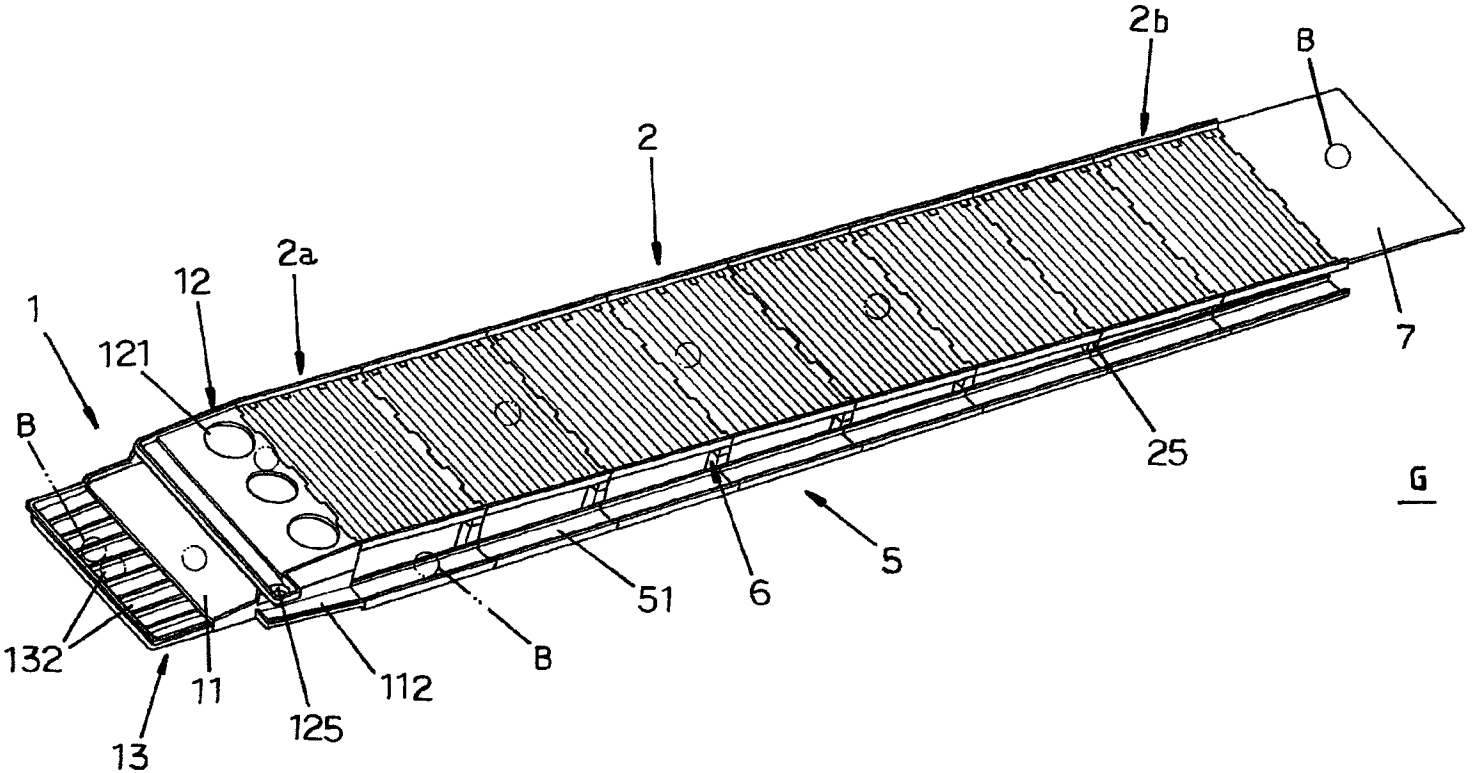
FIG. 10 is a perspective view of the putting green simulator in accordance with the present invention, showing that a ball is in a hitting area.
Figure 11:
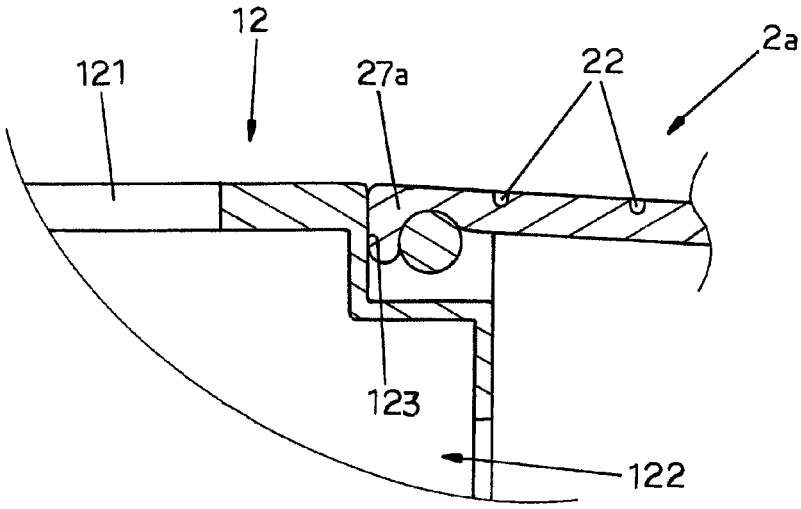
FIG. 11 is a cross sectional view of a part of the putting green simulator in accordance with the present invention, showing that the engaging block is engaged in a groove of a supporting member.

When in assembly, as shown in FIGS. 10 and 11, the putting green simulator in accordance with the present invention is placed on the ground G, the base boards 2 are connected to one another by engaging the engaging blocks 27 in the engaging concaves 28, and the engaging protrusions 32 of the respective stop members 3 are engaged in the engaging grooves 29 of the base boards 2, so that the stop members 3 are connected to one another at the front and rear ends of the base boards 2. The leftmost base board 2*a* of the base boards 2 is fixed to the right end of the supporting member 12 in such a manner that the engaging blocks 27*a* of the leftmost base board 2*a* are engaged in the grooves 123 of the supporting member 12. The rightmost base board 2*b* is placed against the ground G and connected to a hitting area 7.

When in use, the golfer stands in the hitting area 7 and hits a ball B out of the hitting area 7, the stop boards 31 of the stop members 3 can stop the ball B from rolling out of the lateral sides of the putting green simulator. When rolling along the bodies 21 to the supporting member 12, the ball B falls into the aperture 121 and then falls into the concave portion 122 and moves along the slope 111 and into one of the receiving grooves 132 of the receiving concave 131. The golfer scores when there are ball B in each of the receiving grooves 132, which makes the golf practicing more fun. When failing to fall into the aperture 121 and the concave portion 122, the ball B will fall into the inclined guiding section 112 via the ball falling hole 125 and finally move back to the hitting area 7 along the guiding track 51 of the ball return member 5.

There are two circumstances when the putting green simulator of the present invention is used.

Referring to FIGS. 7 and 9, for the first circumstance, the base boards 2 are connected to each other and fixed to the right end of the base assembly 1, adjusting the length of the first screws 26 exposed out of the first screw seats 25 or the length of the second screws 63 exposed out of the threaded pipes 62 can adjust the height of the bodies 21 with respect to the ground G, consequently adjusting the inclination of the bodies 21.

Figure 2:
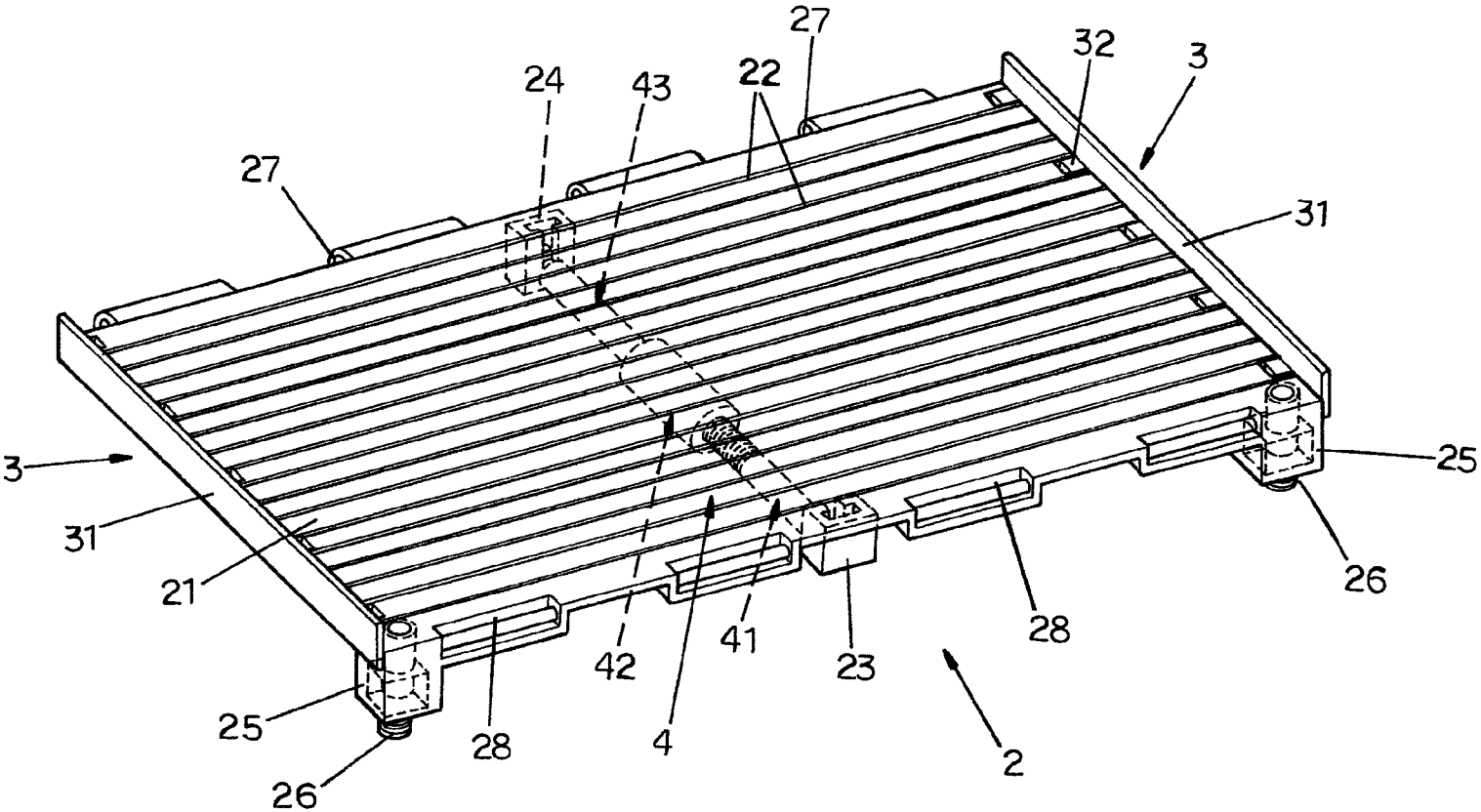
FIG. 2 is a perspective view of a base board in accordance with the present invention.
Figure 3:
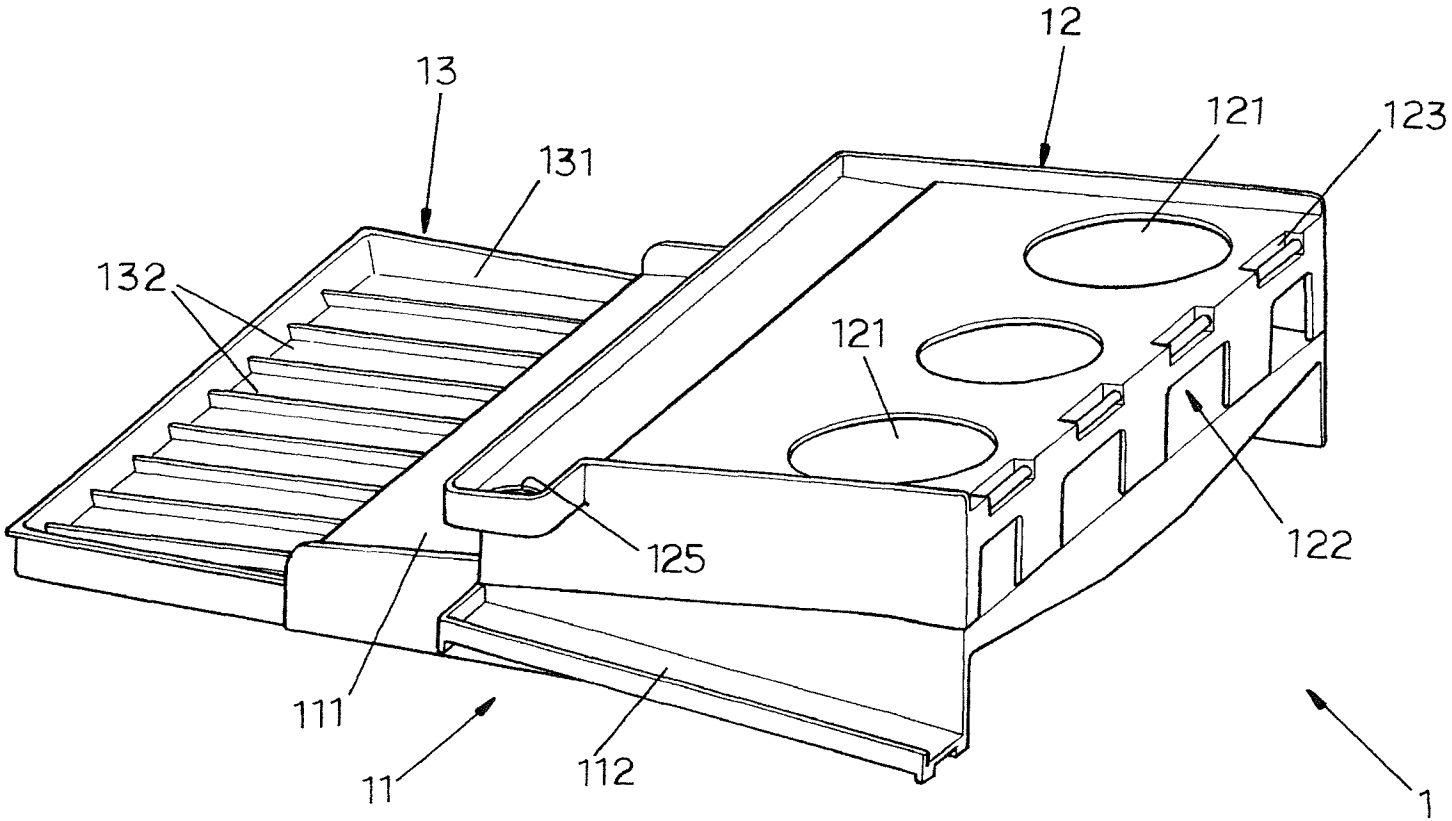
FIG. 3 is a perspective view of a base assembly in accordance with the present invention.
Figure 4:
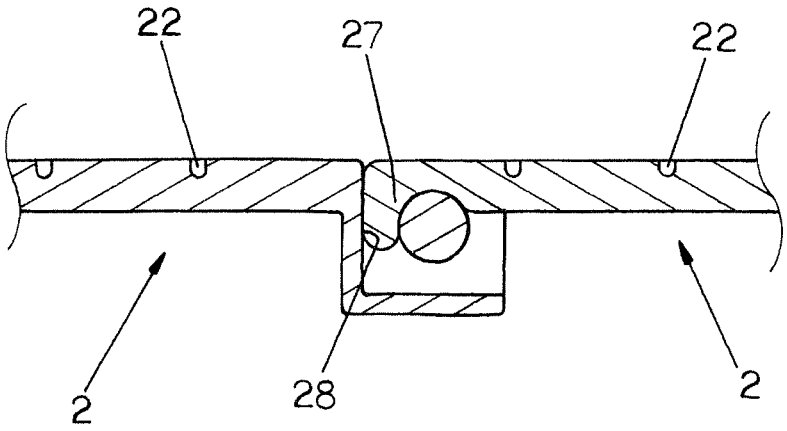
FIG. 4 is a cross sectional view of a part of the putting green simulator in accordance with the present invention, showing that an engaging block is engaged in an engaging concave.
Figure 12:
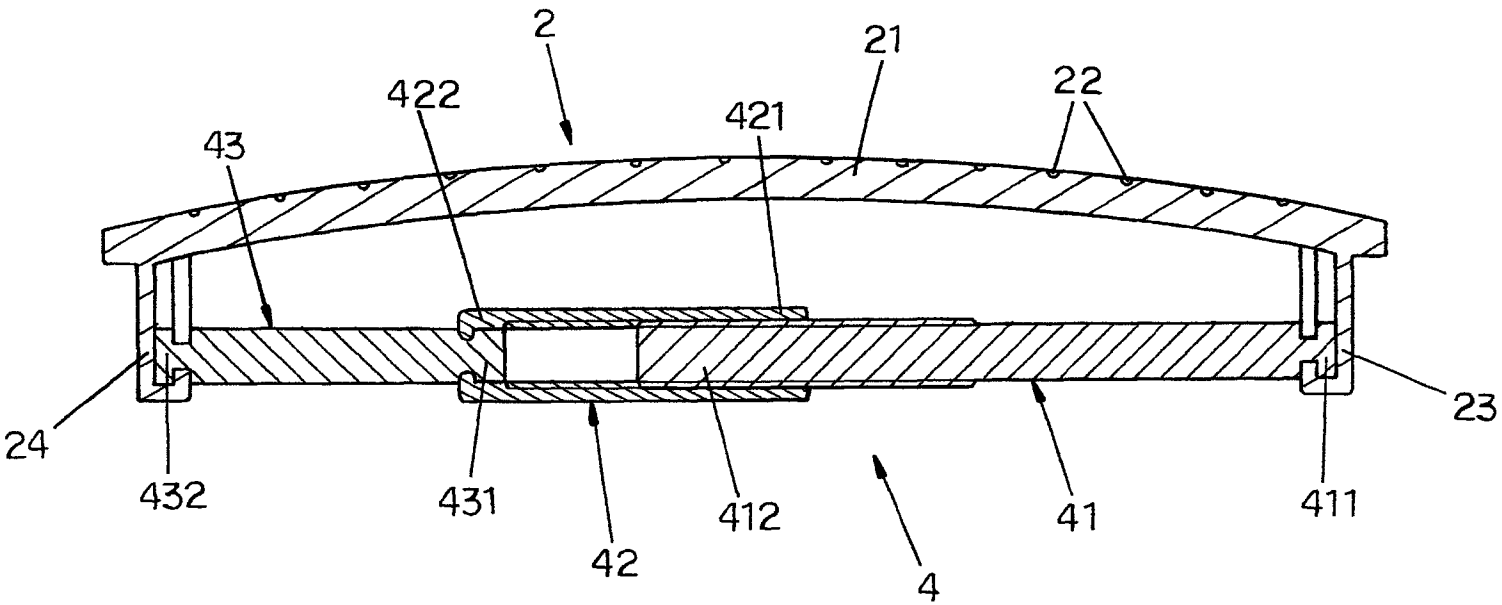
FIG. 12 is a cross sectional view of a part of the putting green simulator in accordance with the present invention, showing that a body of the base board is adjusted to be arch-shaped by rotating the threaded sleeve.

Referring then to FIG. 12, for the second circumstance, since the base boards 2 are flexible, and each adjusting member 4 is vertical to the spaced grooves 22 of the respective bodies 21 (as shown in FIG. 2) after being mounted on the base boards 2, rotating the threaded sleeve 42 can extend or retract the bolt 41, so that the body 21 of the base board 2 will become arc, namely, the curvature of the bodies 21 can be adjusted.

Figure 15:
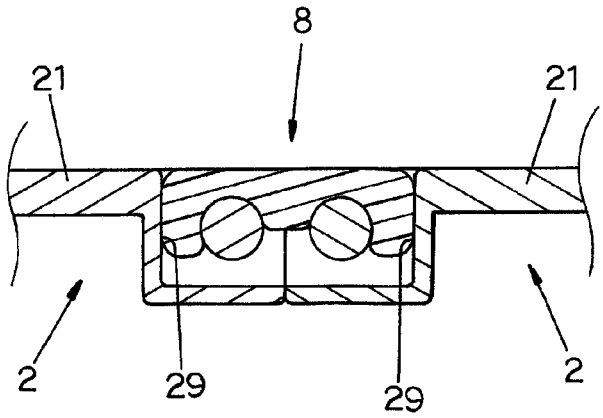
FIG. 15 is a cross sectional view of a part of FIG. 14.
Figure 13:
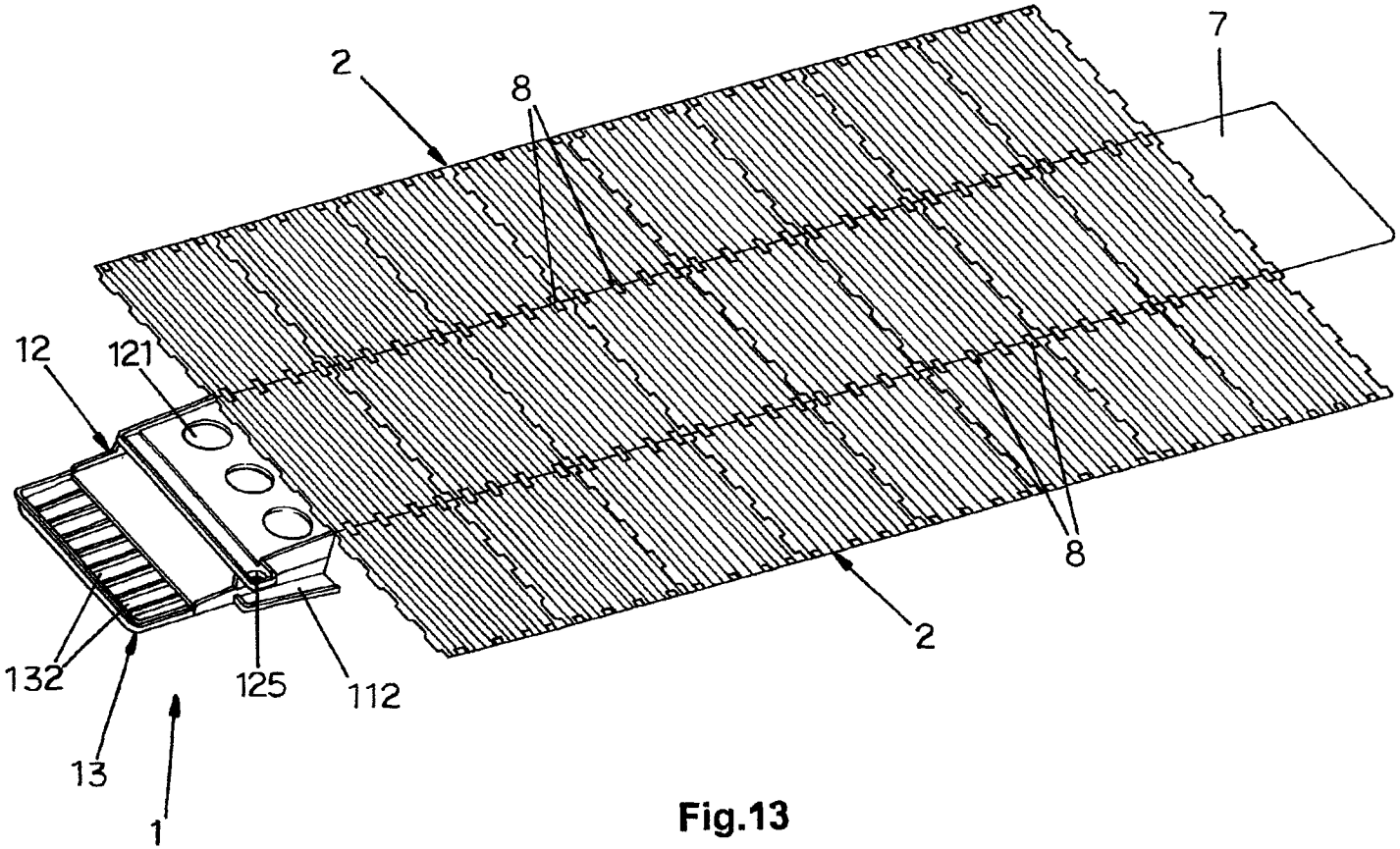
FIG. 13 is a perspective view of a part of the putting green simulator in accordance with the present invention, showing that a plurality of base boards are connected to one another with the front ends abutting against the rear ends.
Figure 14:
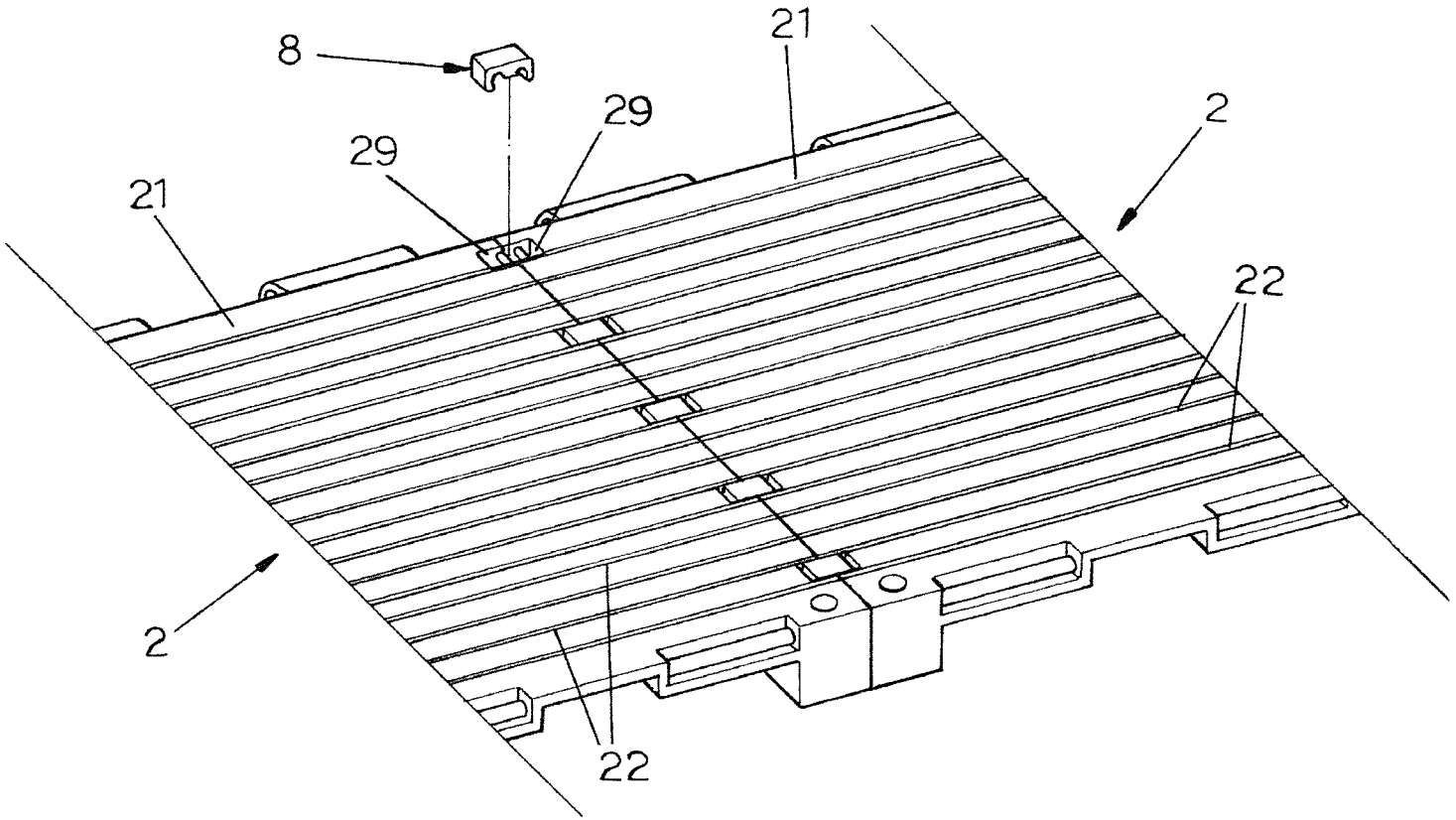
FIG. 14 is a perspective view of a part of the putting green simulator in accordance with the present invention, showing that two base boards are jointed by a connecting member.

Referring to FIGS. 13-15, the present invention further comprises a plurality of connecting members 8 which can adjust the width of the putting green simulator. Firstly, the stop members 3 are removed from the base boards 2, and then the base boards 2 are abutted against one another with the front ends abutting against the rear ends. At this moment, the engaging grooves 29 of neighboring base boards 2 are aligned, and then the connecting members 8 are engaged in the engaging grooves 29, so that the base boards 2 are jointed to increase the width of the putting green simulator.

To summarize, the present invention has the following advantages.

Firstly, the first screws 26 are screwed in the first screw seats 25, adjusting the length of the first screws 26 exposed out of the first screw seats 25 can adjust the height of the bodies 21 with respect to the ground G, so as to simulate putting greens of different inclinations.

Secondly, the base boards 2 are flexible, rotating the threaded sleeve 42 can extend or retract the bolt 41, so that the curvature of the bodies 21 can be adjusted, so as to simulate different curvatures of the putting green, making the putting more difficult and more fun.

Thirdly, the golfer puts the ball B into the aperture 121 and then the ball B falls into the concave portion 122 and moves along the slope 111 into one of the receiving grooves 132 of the receiving concave 131. The golfer scores when there are balls B in each of the receiving grooves 132, this makes the golf practicing more fun.

While we have shown and described various embodiments in accordance with the present invention, it is clear to those skilled in the art that further embodiments may be made without departing from the scope of the present invention.

What is claimed is:

1. A putting green simulator comprising:

a base assembly including a base, and a supporting member on the base, the supporting member being formed with at least one aperture, a plurality of spaced grooves being formed at a right end of the supporting member;

a plurality of base boards, each of the base boards being flexible and including a body, a first chamber and an opposite second chamber protruding downward from the body, two opposite first screw seats protruding downward from the body, a plurality of spaced engaging blocks formed at a left end of the body, and a plurality of engaging concaves formed at a right end of the body; and a plurality of adjusting members, each of the adjusting members including a bolt, a threaded sleeve and a connecting rod, the bolt having a first end fixed in the first chamber and a second end, the threaded sleeve having a first end and a second end screwed with the second end of the bolt, the connecting rod having a first end pivoted to the first end of the threaded sleeve and a second end fixed to the second chamber;

the base boards being connected to one another by engaging the engaging blocks in the engaging concaves, a leftmost base board of the base boards being fixed to the right end of the supporting member in such a manner that the engaging blocks of the leftmost base board are engaged in the grooves of the supporting member.

2. The putting green simulator as claimed in claim 1 further comprises a ball receiving member at a left end of the base, the ball receiving member is formed with a receiving concave and a plurality of receiving grooves formed in the receiving concave, the base is provided with a slope connected to the receiving concave, the supporting member is formed with a concave portion in communication with the at least one aperture, the concave portion is connected to the slope of the base.

3. The putting green simulator as claimed in claim 1 further comprises a ball return member which includes a guiding track, the base is provided with an inclined guiding section connected to the guiding track, and the supporting member is formed with a ball falling hole connected to the inclined guiding section.

4. The putting green simulator as claimed in claim 1 further comprises two first screws screwed to the first screw seats.

5. The putting green simulator as claimed in claim 1 further comprises a plurality of second screw seats, each of the second screw seats includes an engaging portion for engaging with the first screw seat, a threaded pipe extending downward from the engaging portion, and a second screw screwed to the threaded pipe.

6. The putting green simulator as claimed in claim 1 further comprises a plurality of stop members which are mounted to front and rear ends of the respective body and each include a stop board and a plurality of engaging protrusions formed on the stop board for engaging with a plurality of engaging grooves formed at the front and rear ends of the body.

7. The putting green simulator as claimed in claim 1, wherein each of the base boards is provided with a plurality of spaced grooves which are formed in the body and vertical to the adjusting members.

* * * * *